US012528521B2

(12) United States Patent
Kress et al.

(10) Patent No.: US 12,528,521 B2
(45) Date of Patent: Jan. 20, 2026

(54) RAILCAR GATE ADAPTOR AND RAILCAR MODIFICATION USING THE SAME

(71) Applicant: JAC Operations, Inc., Chicago, IL (US)

(72) Inventors: Michael H. Kress, Armagh, PA (US); Gregory P. Josephson, Salix, PA (US); Ethan Ryan Terrel, Danville, AL (US)

(73) Assignee: JAC Operations, Inc., Chicago, IL (US)

( * ) Notice: Subject to any disclaimer, the term of this patent is extended or adjusted under 35 U.S.C. 154(b) by 906 days.

(21) Appl. No.: 17/736,046

(22) Filed: May 3, 2022

(65) Prior Publication Data

US 2022/0371627 A1 Nov. 24, 2022

Related U.S. Application Data

(60) Provisional application No. 63/183,076, filed on May 3, 2021.

(51) Int. Cl.
*B61D 7/02* (2006.01)

(52) U.S. Cl.
CPC ..... *B61D 7/02* (2013.01)

(58) Field of Classification Search
CPC ... B61D 7/00; B61D 7/02; B61D 7/04; B61D 7/14; B61D 7/32
See application file for complete search history.

(56) References Cited

U.S. PATENT DOCUMENTS

2009/0120323 A1* 5/2009 Forbes ..... B61D 7/02 105/248
2018/0194372 A1* 7/2018 Early ..... B61D 7/26

FOREIGN PATENT DOCUMENTS

CN 104554303 A * 4/2015 ..... B61D 7/02
WO WO-2014128450 A1 * 8/2014 ..... B61D 7/02
WO WO-2020220129 A1 * 11/2020 ..... B61D 7/02

* cited by examiner

*Primary Examiner* — Robert J McCarry, Jr.
(74) *Attorney, Agent, or Firm* — Blynn L. Shideler; Krisanne Shideler; BLK Law Group

(57) ABSTRACT

A railcar modification comprises a pair of spaced trucks; a multiple bay hopper railcar body on the pair of trucks; a hopper floor in the railcar body, wherein each bay of the hopper railcar body has hoppers formed of sloped floor sheets having a hopper floor slope; a plurality of gate adaptors, each gate adapter coupled to the floor sheets of a hopper, wherein the gate adapter includes a plurality of floor sheet panels, a plurality of transition panels and a plurality of gate panels, and wherein a difference in slope angles between the floor sheet panels, transition panels and gate panels combine to form a vertical offset; and a plurality of gates, each gate coupled to one gate adapter.

15 Claims, 4 Drawing Sheets

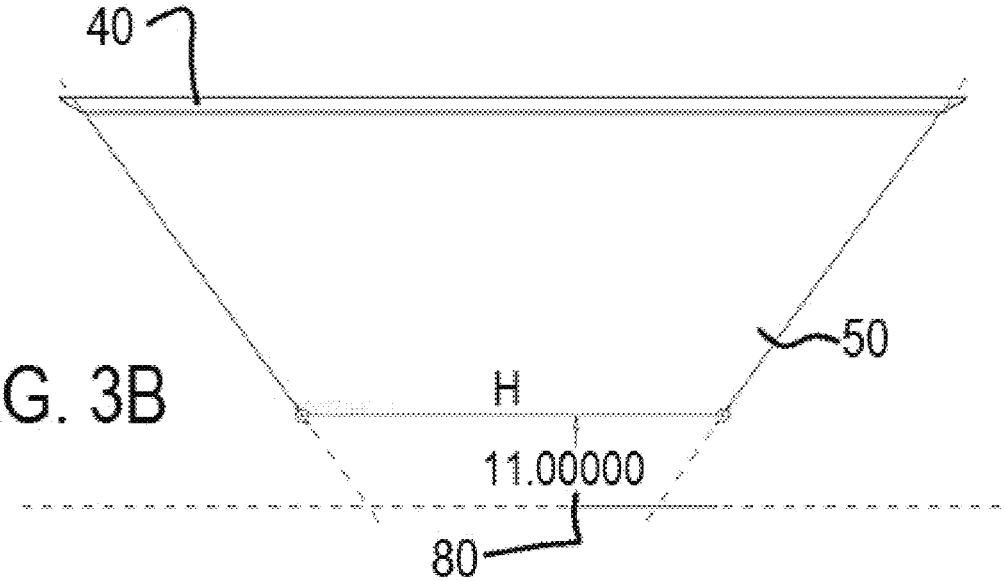
FIG. 3B
FIG. 4
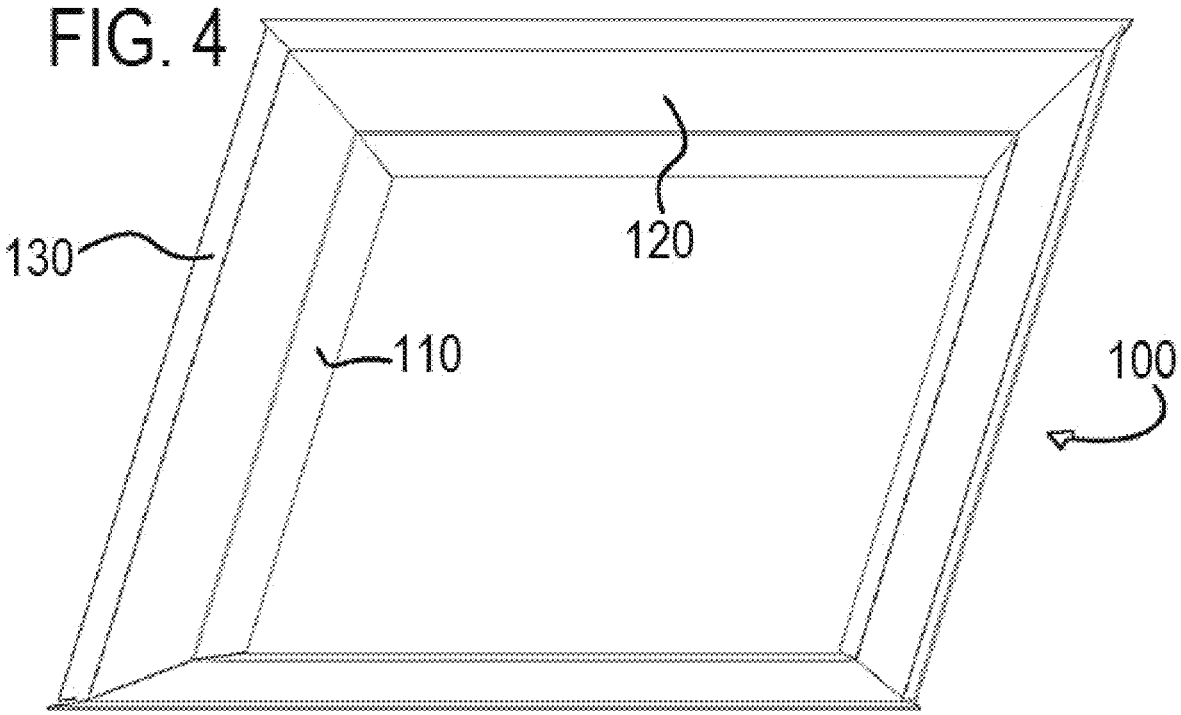

RAILCAR GATE ADAPTOR AND RAILCAR MODIFICATION USING THE SAME

RELATED APPLICATIONS

This application claims the benefit of U.S. Provisional Patent Application Ser. No. 63/183,076 titled "Railcar Gate Adaptor and Railcar Modification Using the Same" filed May 3, 2021 which is incorporated herein by reference in its entirety.

BACKGROUND OF THE INVENTION

1. Field of the Invention

The present invention relates to a railcar gate adaptor allowing the adjustment of the height and size of gate outlets depending upon car application.

2. Background Information

In hopper style railcars there is typically one or more hopper doors at the bottom of the hopper for selectively dumping the laden. The desired height and size of the outlet gate can vary depending upon the particular application of the railcar.

Railcar owners will sometimes desire to change the primary designation or purpose of a railcar based upon commercial need, and this change in the railcar's primary designation (AKA repurposing) can result in a desire for an altered outlet gate height and/or gate size. Historically, when hopper railcar owners wish to repurpose a hopper railcar with new gates for a distinct laden type, generally at a new gate outlet height and often new dimension, the old gates are removed and the entire hopper floor replaced with new flooring that is sized to the new gate designation. This generally results in a rebuild of the entire hopper railcar floor design.

"Modification" is Association of American Railroads (AAR) defined term (see Office Manual of the AAR Interchange Rules, rule 88(d)(2)) defined as a change to a car that alters capacity of car, or size of car type, or type of lading being hauled. This application uses the terms "modification" and "modify" in connection with this rule whereby within this application rail car modification programs reference programs that will modify railcars within the meaning of this AAR rule.

There is a need for effective and efficient modification methodologies for hopper railcar outlet gates.

SUMMARY OF THE INVENTION

One aspect of the present invention provides a railcar modification including a pair of spaced trucks; a multiple bay hopper railcar body on the pair of trucks; a hopper floor in the railcar body, wherein each bay of the hopper railcar body has hoppers formed of sloped floor sheets having a hopper floor slope; a plurality of gate adaptors, each gate adapter coupled to the floor sheets of a hopper, wherein the gate adapter includes a plurality of floor sheet panels, a plurality of transition panels and a plurality of gate panels, and wherein a difference in slope angles between the floor sheet panels, transition panels and gate panels combine to form a vertical offset; and a plurality of gates, each gate coupled to one gate adapter.

One aspect of the present invention provides a gate adaptor configured to couple a gate to floor sheets of a floor of a hopper railcar comprising a plurality of floor sheet panels, a plurality of transition panels and a plurality of gate panels, and wherein a difference in slope angles between the floor sheet panels, transition panels and gate panels combine to form a vertical offset.

These and other advantages of the present invention will be clarified in the following description of the preferred embodiment in which like reference numerals represent like elements throughout.

BRIEF DESCRIPTION OF THE FIGURES

FIGS. 3A and 3B are elevated side and end views of the hopper floor of FIG. 2.

FIGS. 4 illustrates a railcar gate adaptor according to the present invention for use with the hopper floor of FIG. 2 used in the railcar modification methodologies according to the present invention.

DESCRIPTION OF THE PREFERRED EMBODIMENTS

Figure 1:
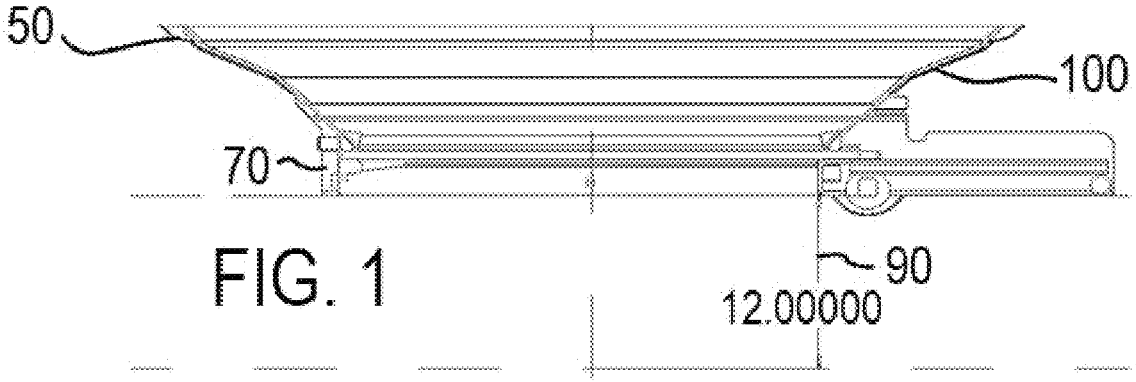
FIG. 1 is a schematic sectional view of a railcar gate adaptor according to the present invention shown with a conventional sliding door hopper gate.

It is an object of the present invention to provide for an effective and efficient railcar gate adaptor 100 that yield effective and efficient modification methodologies for hopper railcars 10 for adjusting gate 70 heights and/or sizes. The invention yields a railcar modification 10 (or simply a railcar 10) including a pair of spaced trucks 20; a multiple bay hopper railcar body 30 on the pair of trucks 20; a hopper floor 40 in the railcar body 30, wherein each bay of the hopper railcar body has hoppers formed of sloped floor sheets 50 of the floor 40 having a hopper floor slope; a plurality of gate adaptors 100, each gate adapter 100 coupled to the floor sheets 50 of a hopper of the floor 40, wherein the gate adapter 100 includes a plurality of floor sheet panels 130, a plurality of transition panels 120 and a plurality of gate panels 110, and wherein a difference in slope angles between the floor sheet panels 130, transition panels 120 and gate panels 110 combine to form a vertical offset; and a plurality of gates 70, each gate 70 coupled to one gate adapter 100.

The present invention is directed to hopper railcars 10, and more particulalry the present invention relates to a railcar gate adaptor 100 allowing the adjustment of the height and size of gate outlets 70 depending upon car 100 application. Two main types of hopper cars 10 exist: covered hopper cars 10 (as shown), which are equipped with a roof 60, and open hopper cars, which do not have a roof 60.

This hopper type of rail car 10 is distinguished from a gondola railcar in that it has opening doors or gates 70 on the underside to discharge its cargo. The development of the hopper car 10 went along with the development of automated handling of such commodities, with automated loading and unloading facilities. Covered hopper cars 10 are often used for bulk cargo such as grain, sugar, and fertilizer that must be protected from exposure to the weather. Open hopper cars are used for commodities such as coal, which can suffer exposure with less detrimental effect to the laden. Hopper cars 10 have been used by railways worldwide whenever automated cargo handling has been desired.

The hopper railroad car 10 of the present invention has a conventional upper body 30 not shown in detail herein and includes a hopper body 30 (covered or open) supported by conventional trucks 20 at either and of the car body 30, with the trucks 12 riding on rails in a conventional fashion.

Generally, the hopper car 10 may be a through sill/center sill car or a stub center sill car with a pair of side sills extending lengthwise of the car 10, one on each side thereof. If the railcar 10 is a stub sill design, structure is provided for joining the stub center sill assembly to side sills for transferring train loads longitudinally of the car 10 from one coupler to the other. Additionally, bolster assemblies are utilized to support the weight of the car 10 and its lading on trucks 12. The car body 30 includes a pair of side walls or sheets extending upwardly from a respective side sill to a respective top chord. Further, the car body 30 includes an end wall or sheet at each end of the car body 30.

As shown in FIG. 1, the railcar gate adaptor 100 according to the present invention is used with a conventional sliding door hopper gate 70 to position the gate 70 a preset or desired distance 90 above the rails (shown as 12" in FIG. 1). This clearance 90 can be set by the operational requirements of the railcar 10, namely it must have a defined clearance for given operational environments. Here the gate 70 or door must be 12" above the rail such that clearance or distance 90 is 12". As described further below the railcar gate adaptor 100 yields and effective and efficient modification methodologies for hopper railcars 10 for adjusting gate 70 heights and/or sizes.

Figure 2:
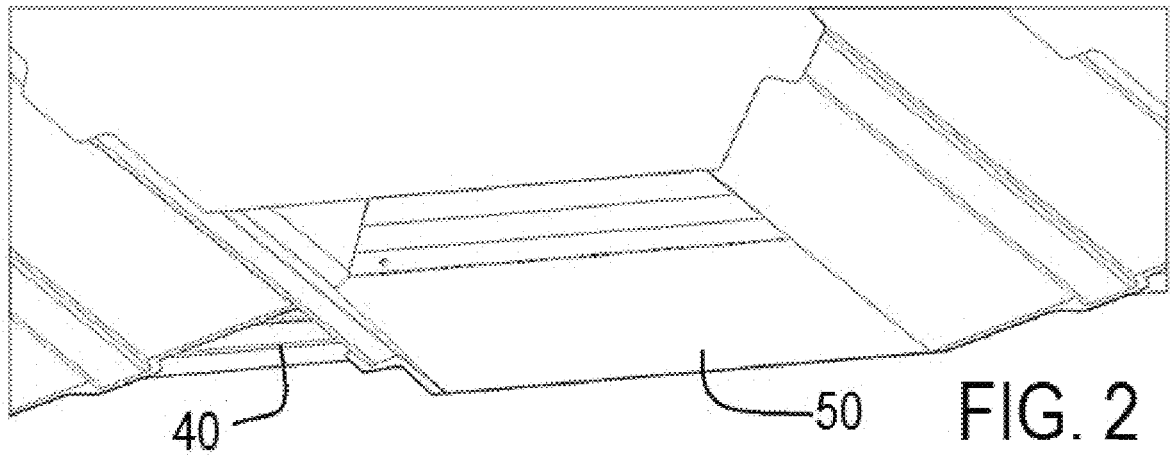
FIG. 2 is a perspective view of a hopper floor used with the railcar gate adaptor of FIG. 1.

As discussed above the present invention provides an effective and efficient railcar gate adaptor 100 that yield effective and efficient modification methodologies for hopper railcars 10 for adjusting gate heights and/or sizes. The railcar gate adaptor 100 of the invention is coupled to the hopper floor 40. The hopper floor 40 essentially can be described as the containment area forming structure located below the side sills. FIGS. 2 and 3 illustrate the hopper floor 40 used with the railcar gate adaptor 100 of FIG. 1.

The hopper floor 40 includes sloped side sheets 50 coupled to the side sill area of the car and sloped hopper end sheets 50 in the transverse direction at the ends of the railcar extending between the side walls. Additionally the hopper floor 40 includes sloped intervening floor sheets 50 extending transversly and extending between the side walls.

The sloped side sheets, sloped hopper end sheets and intervening floor sheets (all 50) combine to form the hoppers of the hopper railcar 10 of the invention, with three hoppers being shown. The intervening floor sheets 50 may have support structures such as gussets (not shown) or cross supports (shown). The sloped side sheets, sloped hopper end sheets and intervening floor sheets 50 may collectively be called floor sheets 50 and define a hopper floor slope which is the angle of these members relative to horizontal.

Figure 5A:
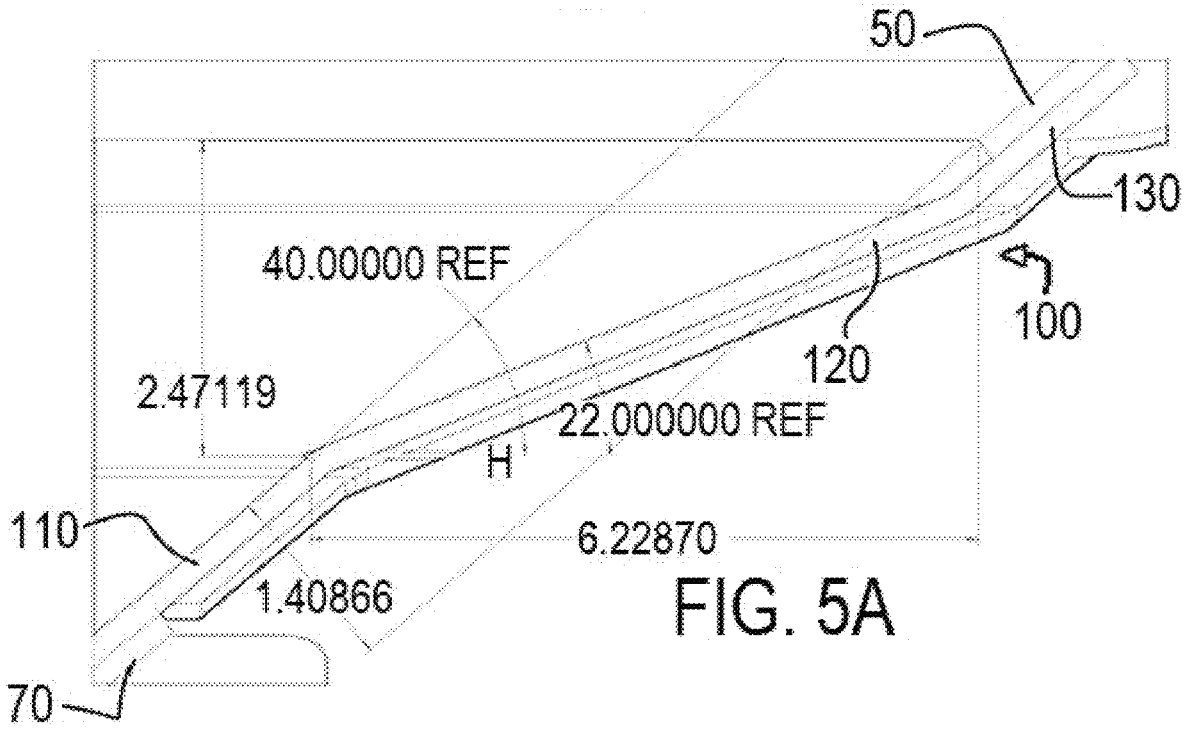
FIGS. 5A, B and C illustrate the railcar gate adaptor of FIGS. 4 for use with the hopper floor of FIG. 2 used in the railcar modification methodologies according to the present invention.
Figure 5B:
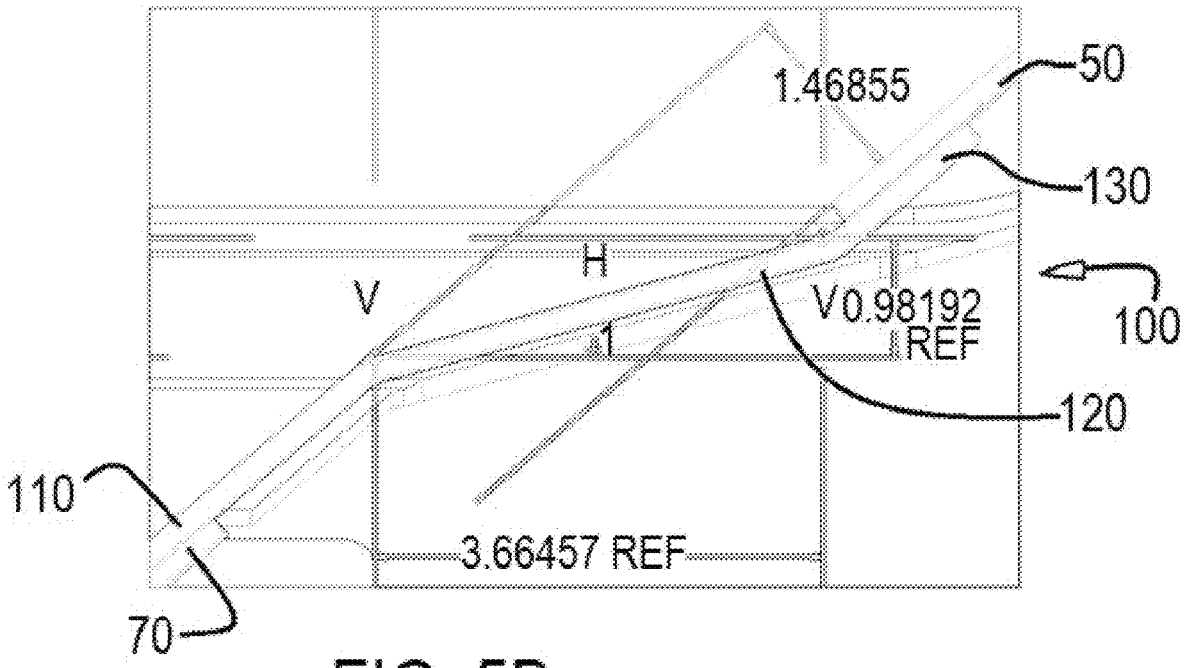
Figure 5C:
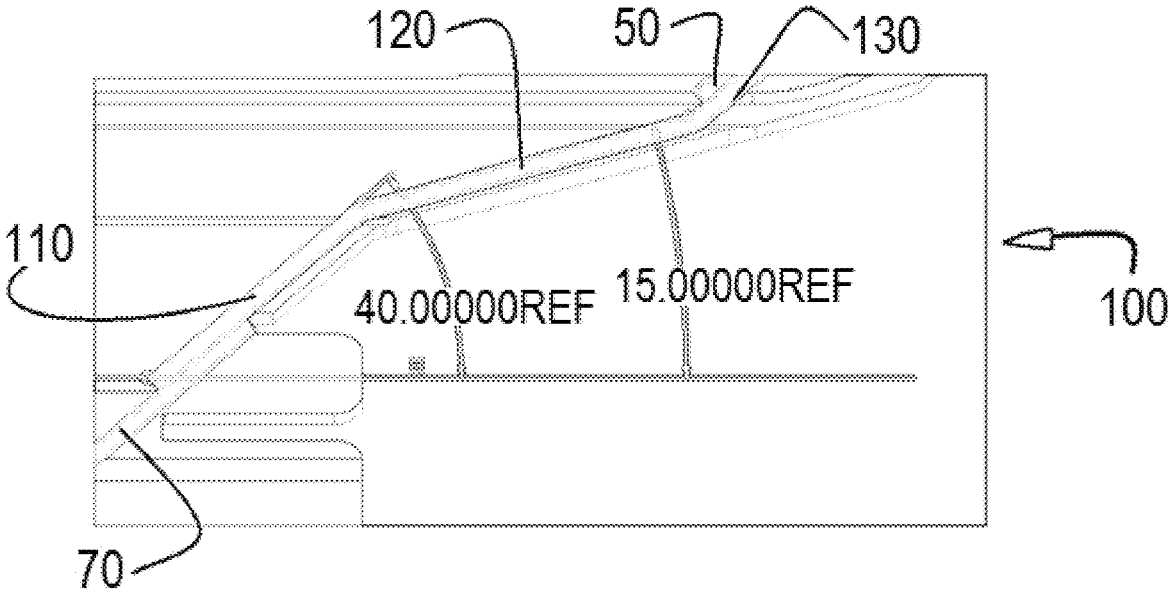

The railcar gate adaptor 100 of the invention is shown in detail in FIGS. 4-5. The railcar gate adaptor 100 includes four floor sheet panels 130 extending around the top of the gate adaptor 100. Each floor sheet panel 130 has a slope angle relative to horizontal configured to match the hopper floor slope angle of an adjacent floor sheet 50 to which it is coupled. Two of the railcar gate adaptor floor sheet panels 130 will be coupled to the side sheets 50 and the other two floor sheet panels 130 will be coupled to adjacent hopper end sheets or intervening floor sheets 50.

The railcar gate adaptor 100 includes four transition panels 120 adjacent to and coupled to the four floor sheet panels 130. Each transition panel 120 has a slope angle relative to horizontal that is less than the slope angle of the floor sheet panel 130 to which it is coupled.

The railcar gate adaptor 100 includes four gate panels 110 adjacent to and coupled to the four transition panels 120. The four gate panels 110 extend around the bottom of the gate adaptor 100. Each gate panel 110 has a slope angle relative to horizontal configured to match the slope angle of an adjacent gate 70 door coupling panel to which it is coupled. Each gate panel 110 has a slope angle relative to horizontal that is greater than the slope angle of the transition panel 120 to which it is coupled. The gate panels110 may have a slope matching the slope of the floor sheet panels 130.

The function of the gate adaptor 100 is to couple the gate 70 to the floor sheets 50 of the floor 40 and the difference in slope angles between the floor sheet panels 130, transition panels 120 and gate panels 110 combine to effectively form a vertical offset as shown in FIG. 5B that can raise the height of the gate 70 (or door) to the preset distance 90. The size of the adaptor 100 is sized to match the gate 70 and the offset is selected to place the gate 70 door height at a desired height 90.

Figure 3A:
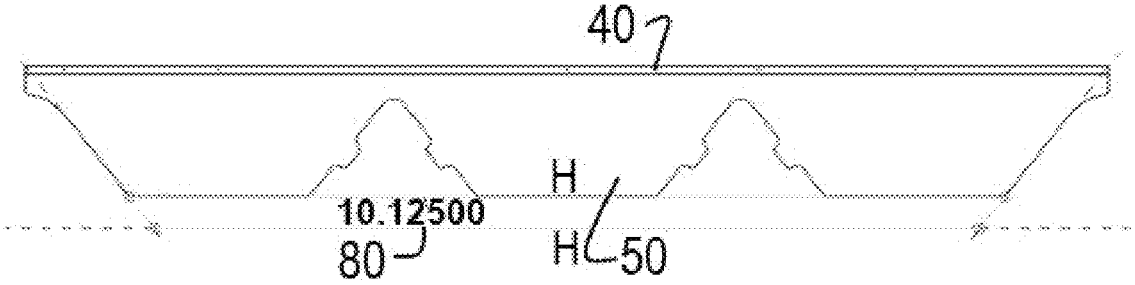
Figure 6:
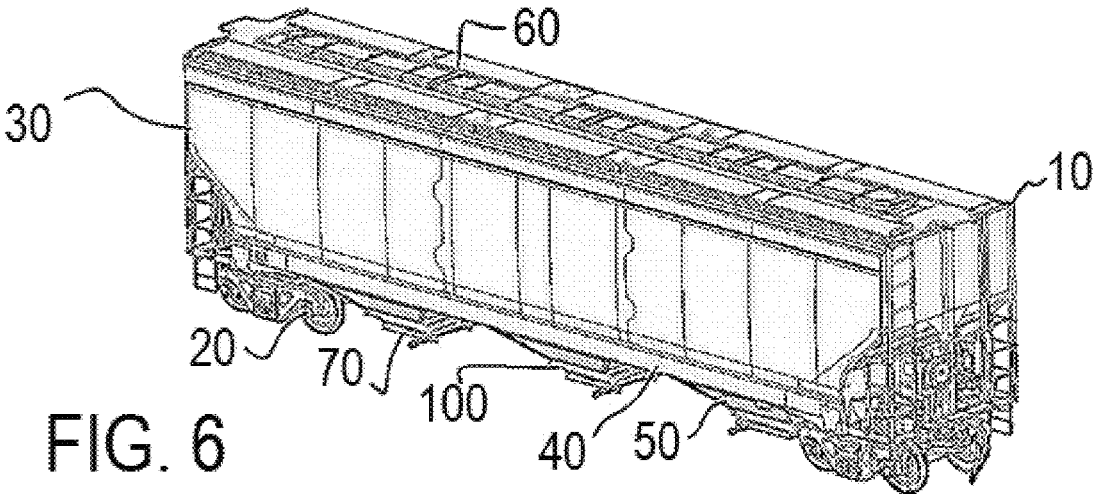
FIG. 6 is a perspective view of a three hopper railcar implementing the gate adaptor of the present invention in a modification thereof.

The adaptor 100 is well suited for use in a modification program of a hopper railcar 10 such as shown in FIG. 6 and /or using the flooring 40 of FIGS. 3A and B. An adaptor 100 according to the present invention can be selected to place a desired gate 70 at a range of heights 90 above the rail. Additionally, the adaptor 100 must have all the panels 110, 120 and 130 sloping down to assure a continuous flow of laden and to avoid areas that will have build-up of laden.

In the modification program the floor sheets 50 of the car being modified are trimmed or cut to leave a distance 80 above the clearance distance to accommodate the adaptor 100. The use of the adaptor avoids the need to rebuild the entire floor structure 40 of the railcar 10 in the modification program.

Whereas particular embodiments of this invention have been described above for purposes of illustration, it will be evident to those skilled in the art that numerous variations of the details of the present invention may be made without departing from the invention as defined in the appended claims. The present invention is not intended to be restricted to the particular embodiments disclosed.

What is claimed is:

1. A railcar comprising:

A pair of spaced trucks;

a multiple bay hopper railcar body on the pair of trucks;

a hopper floor in the railcar body, wherein each bay of the hopper railcar body has hoppers formed of sloped floor sheets having a hopper floor slope;

a plurality of gate adaptors, each gate adapter coupled to the floor sheets of a hopper, wherein the gate adapter includes four floor sheet panels extending around the top of the gate adaptor, four transition panels extending around the periphery of the gate adapter and adjacent to and coupled to the four floor sheet panels and four gate panels extending around the periphery of the gate adapter and adjacent to and coupled to the four transition panels, and wherein a difference in slope angles between the floor sheet panels, transition panels and gate panels combine to form a vertical offset, a plurality of gates, each gate coupled to one gate adapter.

2. The railcar according to claim 1 wherein each railcar gate adaptor has the floor sheet panels with a slope angle relative to horizontal configured to match the hopper floor slope angle of an adjacent floor sheet to which it is coupled.

3. The railcar according to claim 1 wherein each railcar gate adaptor has two of the railcar gate adaptor floor sheet panels coupled to the side sheets and the other two floor sheet panels coupled to adjacent hopper end sheets or intervening floor sheets.

4. The railcar according to claim 1 wherein each railcar gate adaptor includes that each transition panel has a slope angle relative to horizontal that is less than the slope angle of the floor sheet panel to which it is coupled.

5. The railcar according to claim 1 wherein each railcar gate adaptor includes four gate panels that extend around the bottom of the gate adaptor.

6. The railcar according to claim 5 wherein each gate panel of each gate adaptor has a slope angle relative to horizontal configured to match the slope angle of an adjacent gate door coupling panel to which it is coupled.

7. The railcar according to claim 1 wherein each gate panel of each gate adaptor has a slope angle relative to horizontal that is greater than the slope angle of the transition panel to which it is coupled.

8. The railcar according to claim 1 wherein each gate panel of each gate adaptor has a slope angle matching the slope of the floor sheet panels.

9. A gate adaptor configured to couple a gate to floor sheets of a floor of a hopper railcar comprising four floor sheet panels extending around the top of the gate adaptor, four transition panels extending around the periphery of the gate adapter and adjacent to and coupled to the four floor sheet panels and four gate panels that extend around the bottom of the gate adaptor, and wherein a difference in slope angles between the floor sheet panels, transition panels and gate panels combine to form a vertical offset.

10. The gate adaptor according to claim 9 wherein each of the floor sheet panels has a slope angle relative to horizontal configured to match a hopper floor slope angle of an adjacent floor sheet to which it is configured to be coupled.

11. The gate adaptor according to claim 9 wherein two of the railcar gate adaptor floor sheet panels are configured to be coupled to side sheets and the other two floor sheet panels are configured to be coupled to adjacent hopper end sheets or intervening floor sheets.

12. The gate adaptor according to claim 9 wherein each transition panel has a slope angle relative to horizontal that is less than the slope angle of the floor sheet panel to which it is coupled.

13. The gate adaptor according to claim 12 wherein the four gate panels are adjacent to and coupled to the four transition panels.

14. The gate adaptor according to claim 9 wherein each gate panel has a slope angle relative to horizontal configured to match the slope angle of an adjacent gate door coupling panel to which it is configured to be coupled.

15. The gate adaptor according to claim 9 wherein each gate panel has a slope angle relative to horizontal that is greater than the slope angle of the transition panel to which it is coupled.

* * * * *